US009638006B2

(12) United States Patent
Henschel et al.

(10) Patent No.: US 9,638,006 B2
(45) Date of Patent: May 2, 2017

(54) SAFETY SYSTEM FOR WELLS HAVING A CABLE DEPLOYED ELECTRONIC SUBMERSIBLE PUMP

(71) Applicant: Tejas Research & Engineering, LLC, The Woodlands, TX (US)

(72) Inventors: Robert C. Henschel, The Woodlands, TX (US); Thomas G. Hill, Conroe, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 383 days.

(21) Appl. No.: 14/061,211

(22) Filed: Oct. 23, 2013

(65) Prior Publication Data

US 2014/0110122 A1 Apr. 24, 2014

Related U.S. Application Data

(60) Provisional application No. 61/717,169, filed on Oct. 23, 2012.

(51) Int. Cl.

| | |
|---|---|
| ***E21B 34/16*** | (2006.01) |
| ***E21B 34/10*** | (2006.01) |
| *E21B 34/00* | (2006.01) |

(52) U.S. Cl.

CPC ..... *E21B 34/16* (2013.01); *E21B 34/10* (2013.01); *E21B 2034/005* (2013.01)

(58) Field of Classification Search

CPC ..... E21B 2034/005

See application file for complete search history.

(56) References Cited

U.S. PATENT DOCUMENTS

| | | | | |
|---|---|---|---|---|
| 2,798,561 | A * | 7/1957 | True | E21B 17/18 166/321 |
| 4,157,199 | A * | 6/1979 | Klingman | 294/86.29 |
| 8,002,040 | B2 * | 8/2011 | May | E21B 34/10 137/513.3 |
| 2002/0040788 | A1 * | 4/2002 | Hill et al. | 166/382 |
| 2006/0162939 | A1 * | 7/2006 | Vick | E21B 34/10 166/386 |
| 2011/0266472 | A1 * | 11/2011 | Russell | 251/28 |
| 2013/0043034 | A1 * | 2/2013 | Drablier | E21B 43/128 166/338 |

* cited by examiner

*Primary Examiner* — Catherine Loikith

(74) *Attorney, Agent, or Firm* — Tumey L.L.P.

(57) ABSTRACT

A safety system for a well having a cable deployed electronic submersible pump includes a barrier valve having a control line for opening and closing the valve, a first flapper safety valve assembly, and a second flapper safety valve assembly. The second flapper safety valve allows the cable for the pump to pass through the second flapper safety valve when the valve is in a closed position. An integral flapper safety valve assembly incorporates the first and second flapper safety valves.

6 Claims, 6 Drawing Sheets

SAFETY SYSTEM FOR WELLS HAVING A CABLE DEPLOYED ELECTRONIC SUBMERSIBLE PUMP

This application claims priority to provisional application Ser. No. 61/717,169 filed on Oct. 23, 2012.

BACKGROUND OF INVENTION

Field of the Invention

This invention disclosed in this application is directed to a safety system for preventing upward flow of fluid from an oil or gas well in situations where upward flow from the wellbore is undesirable and to components thereof. The system is practically designed for wells wherein a cable deployed electronic submersible pump is used to produce fluid from the well.

BRIEF SUMMARY OF THE INVENTION

The invention is a safety system designed to provide failsafe well control for cable deployed electronic submersible pump (ESP) well completions. The system includes a barrier valve, a first safety valve designed to close prior to deployment of an ESP and a second safety valve designed to close and prevent flow when an electric cable is present in the tubing. The invention includes an integral safety valve assembly that includes both safety valves and the invention also includes a unique flapper valve arrangement for sealing around a cable such as one used for a cable deployed ESP.

BRIEF DESCRIPTION OF THE SEVERAL VIEWS OF THE DRAWING(S)

DETAILED DESCRIPTION OF THE INVENTION

Figure 1:
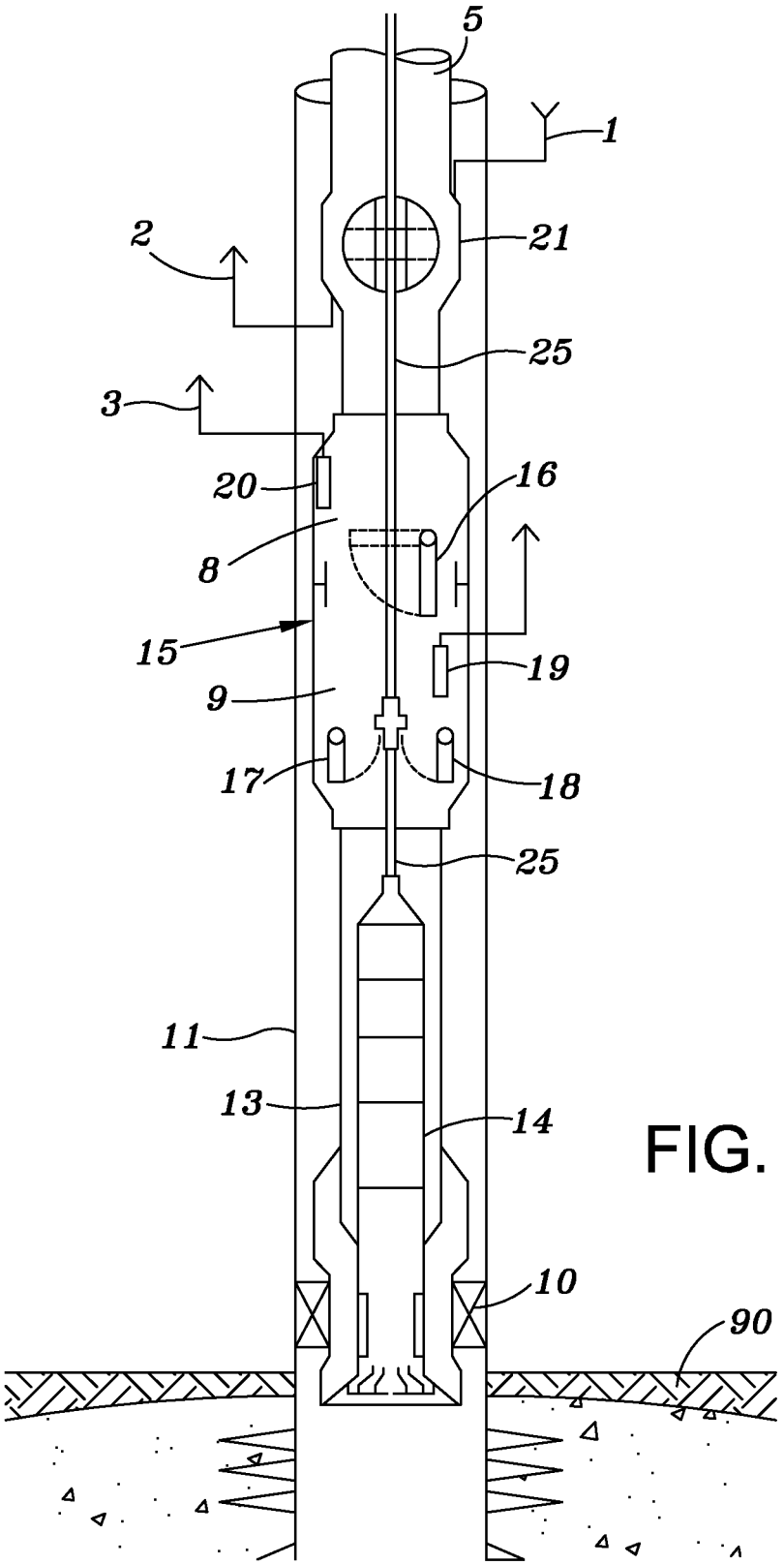
FIG. 1 is a schematic view of the safety system according to an embodiment of the invention.

An embodiment of the safety system according to the invention is shown in FIG. 1. The system is deployed within a well typically including a casing or riser 11 which extends to sea floor 90. The system includes a barrier valve 21 connected for example to production tubing 5. Barrier valve 21 is remotely actuated via control line 1. Barrier valve 21 is connected to an integral safety valve assembly 15 which includes a first flapper valve assembly 8. First flapper valve assembly 8 includes a piston within a pressure chamber 20 which can be moved axially by fluid pressure introduced above the piston via control line 2 to the chamber. The piston may be connected to a flow tube such that as the piston moves downwardly, the flow tube opens the flapper valve 16 which is biased to a closed position by spring 46 as is known in the art. The first flapper valve assembly 8 is normally maintained in an open position by the pressure applied through control line 3.

A second flapper valve assembly 9 is provided in the integral safety valve assembly and includes a pair of flapper valve elements 17 and 18 that are capable of sealing the production tubing in an emergency while a cable 25 is positioned within the tubing as will be explained hereinafter. An electronic submersible pump 14 is supported by a cable 25 and is positioned within tubing 13. In the production mode a packer 10 isolates the production zone as is typical in the art.

Second flapper valve assembly 9 also includes a piston located within a pressure chamber 19 and axially movable via a control line 4. The piston is connected to a specially design flow tube to sequentially open flapper valve elements 17 and 18 in a manner to be discussed below. Second flapper valve assembly 9 can be maintained in an open position by pressure applied through control line 4.

In operation, the barrier valve and both flapper valve assemblies are placed in the open condition and the electronic submersible pump is lowered through the valves and production tubing to a position where the pump inlet is below packer 10 as shown in FIG. 1. In the event it is necessary to prevent flow of production fluid through tubing 5, second flapper valve assembly 9 can be closed by relieving pressure via control line 4. Second flapper valve assembly 9 will prevent upward fluid flow even though cable 25 is positioned within the production tubing as described below.

Figure 2A:
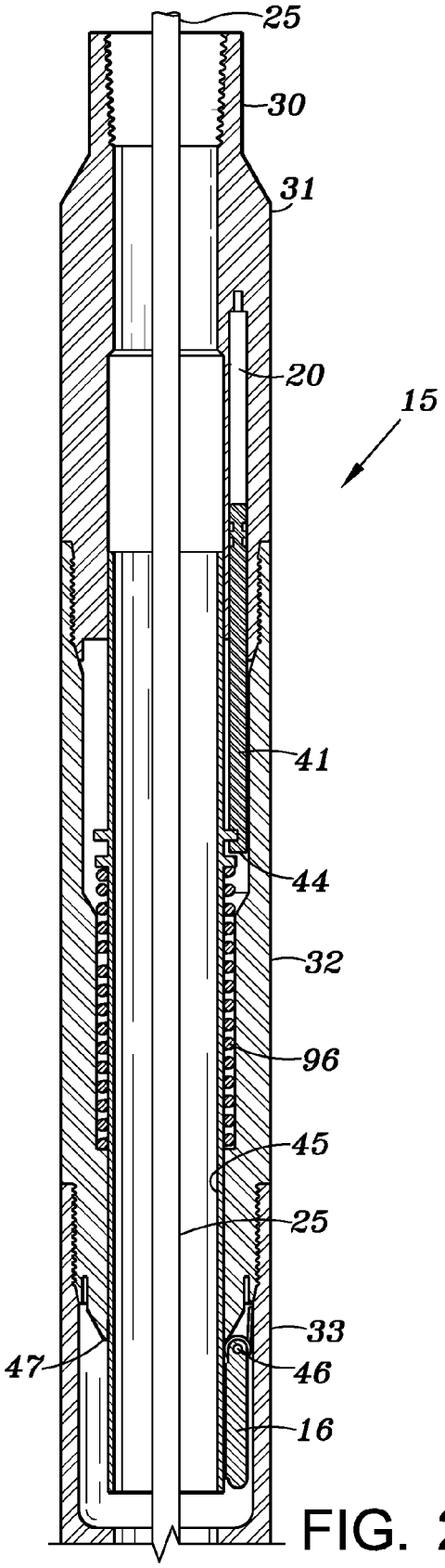
FIGS. 2A, 3A and 4A are cross sectional views of the integral safety valve assembly with the first valve in the open position and the second valve in the closed position according to an embodiment of the invention.
Figure 3A:
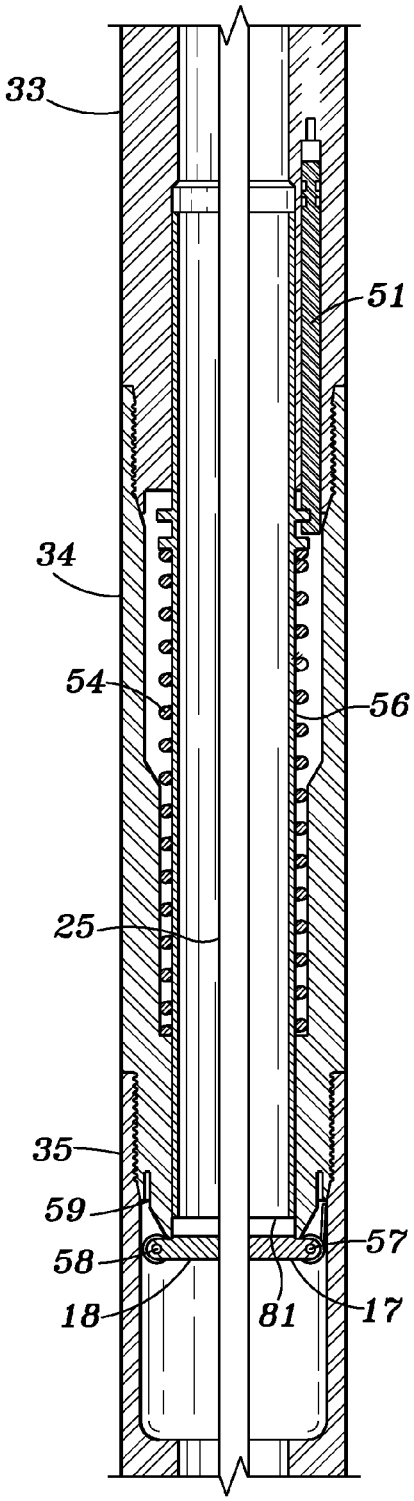

FIGS. 2A and 3A illustrate the details of the integral safety valve assembly 15 with the upper valve in the open position and the lower valve in the closed position. Integral safety valve assembly 15 consists of five tubular housing components 31, 32, 33, 34 and 35 that are connected together by any suitable connection such as threads.

Figure 2B:
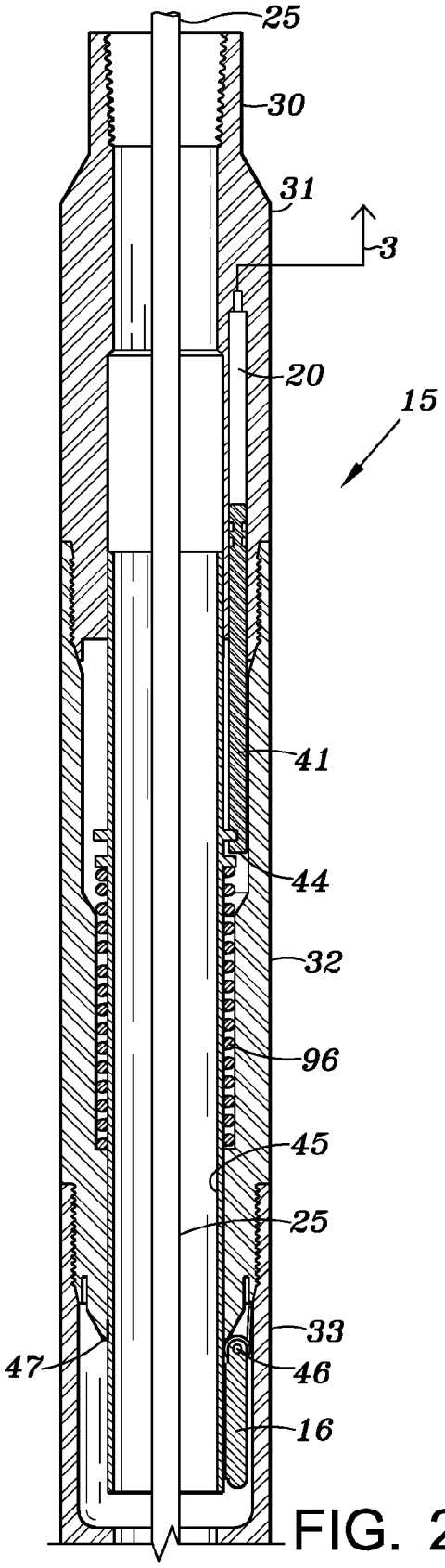
FIGS. 2B, 3B and 4B are cross sectional views of the integral safety valve assembly with both valves in the open position according to an embodiment of the invention.

Housing component 31 has a conventional coupling 30 for coupling to a tubular such as completion tubing. A first piston 41 is located in a pressure chamber 20. A pressure control line 3 is connected to an upper portion of the pressure chamber 20 as shown in FIG. 2B. Piston 41 is connected by a suitable connector 44 to a flow tube 45 that extends past valve seat 47 and holds flapper valve 16 in an open position. In the open position fluid pressure in chamber 20 moves piston 41 and flow tube 45 in a downward direction to open flapper valve 16. This also caused compression of spring 96. In the open position shown in FIG. 2A, cable 25 extends through the first flapper valve assembly.

Figure 3B:
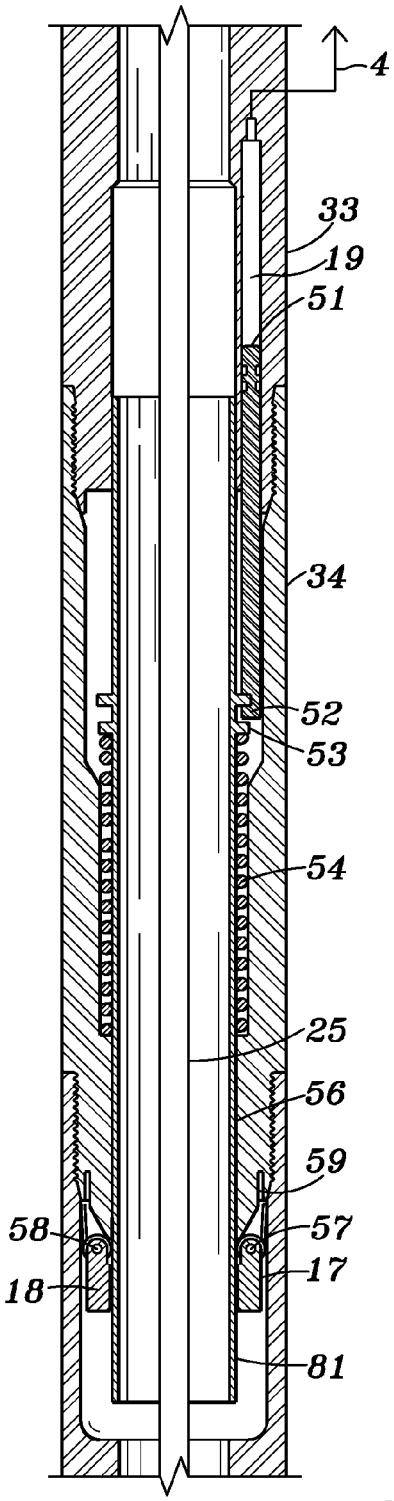

Tubular valve housing component 33 includes a second pressure chamber 19 having a piston 51 located therein. Piston 51 is connected via coupling 53 and 52 to a second flow tube 56 which extends to flapper valve seat 59 when the second flapper valve assembly is in the closed position as shown in FIG. 3A. In the open position, as shown in FIG. 3B, lower portion 81 of flow tube 56 extends through valve seat 59 thus opening flapper valve elements 17 and 18.

Figure 4A:
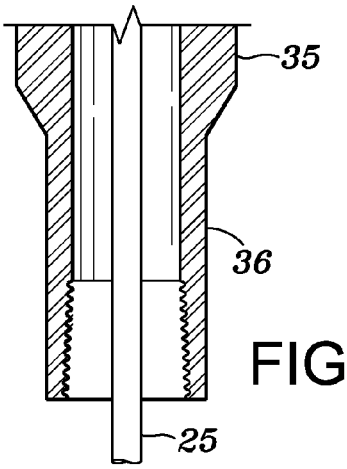
Figure 4B:
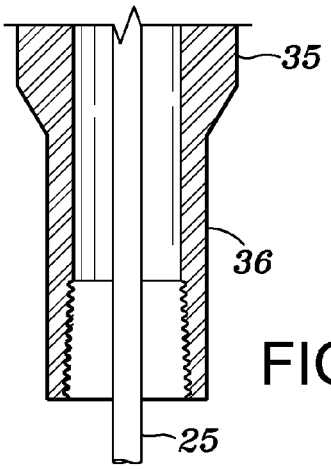

As shown in FIGS. 4A and 4B the lowermost housing component has a coupling 36 for connection to a tubular.

Figure 5:
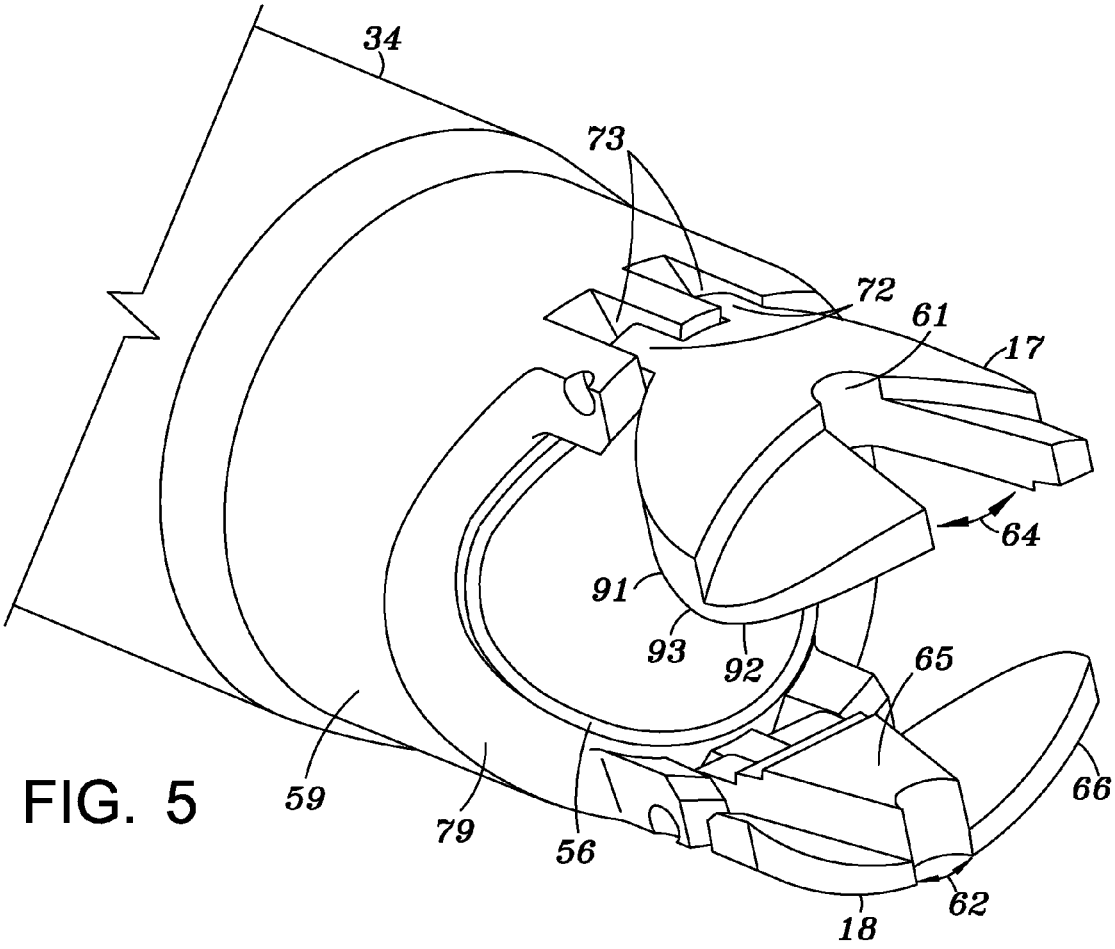
FIG. 5 is a perspective view of a two piece flapper valve in an open position according to an embodiment of the invention.
Figure 6:
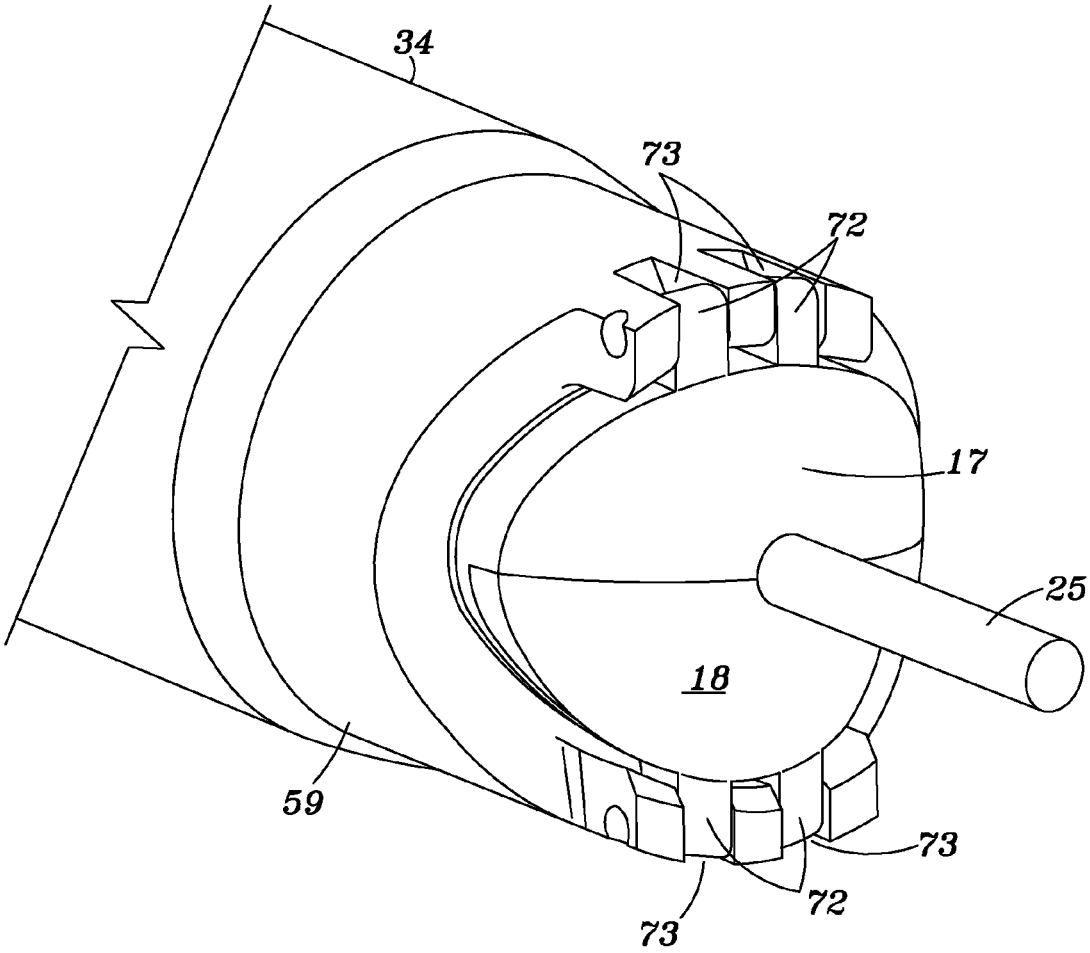
FIG. 6 is a perspective view of the two piece flapper valve of FIG. 5 in the closed position.
Figure 7:
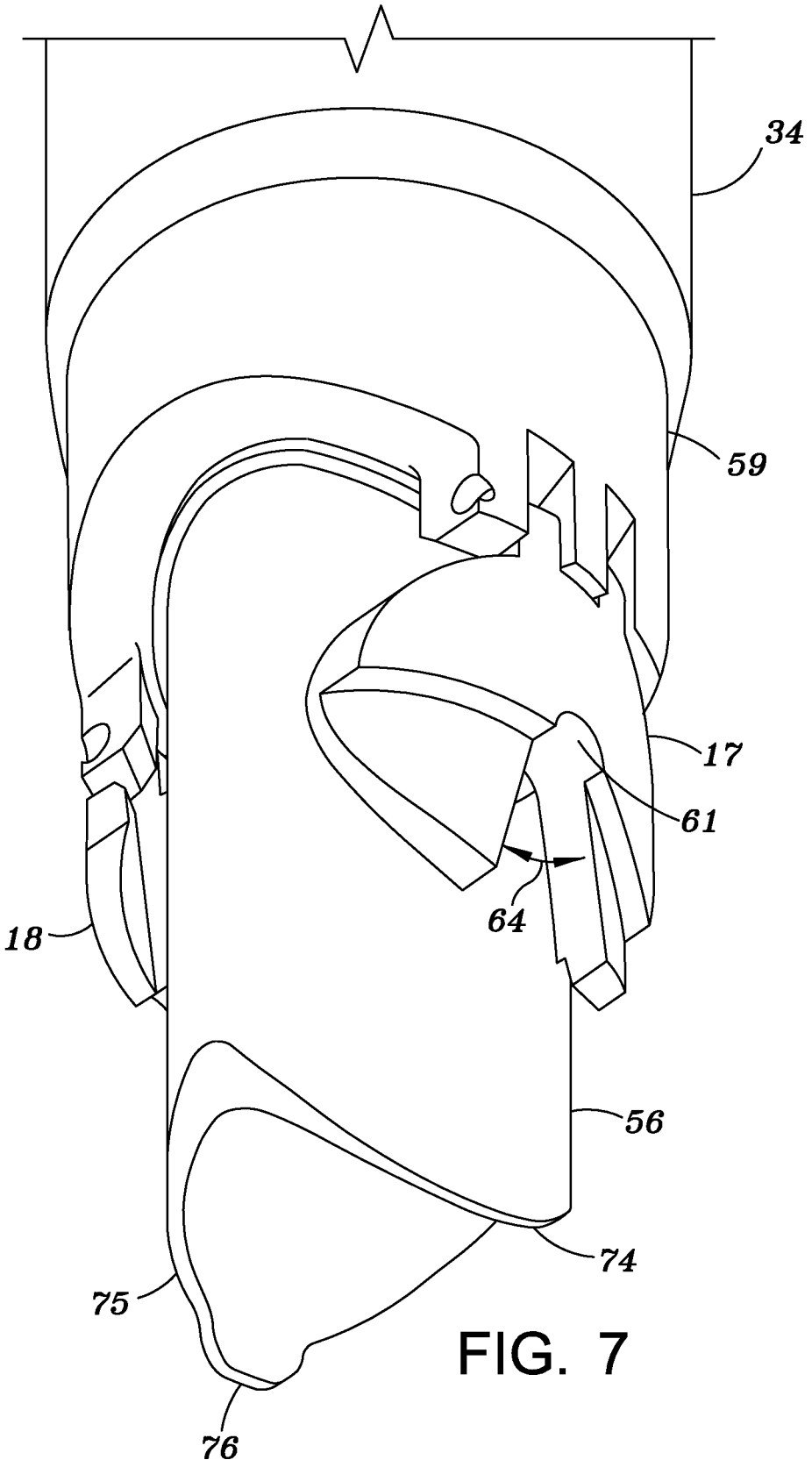
FIG. 7 is a perspective view of the two piece flapper valve of FIG. 5 in the open position with the flow sleeve extending through the valve seat.

FIGS. 5-7 illustrate the details of the flapper valve elements and the flow tube according to an embodiment of the invention.

As shown in FIG. 5, an upper flapper valve element 17 is pivotally mounted to the valve seat 59 in any suitable manner for example by tabs 72 provided an upper flapper valve element 17 that fit within slots 73 provided on valve seat 59.

A pivot pin and spring 57 pivotally mount the element 17 so as to be biased in the closed position. Valve seat 79 may have a saddle contour 56 as is well known in the art or any other conventional shape. The sealing surfaces of flapper valve elements 17 and 18 have a complimentary contour. First flapper valve element 17 has a disc like profile having a v-shaped cutout notch as indicated at 64. A semi-circular cutout section 61 at the bottom of the v-shaped notch extends through the element 17 to accommodate the cable 25 which passes through the second flapper valve assembly in the closed position. First flapper valve element 17 has a first relatively thick portion 91 and a second relatively thinner portion 92 formed by a step 93.

Second flapper valve element 18 is formed so as to mate with the corresponding surfaces of the first flapper valve element 17. Second flapper valve element 18 includes a first v-shaped raised portion 65 with a semi-circular cutout section 62 which fits within v-shaped groove 64 of first flapper valve element 18. Cutouts 61 and 62 form a bore in the closed position to accommodate cable 25 when the valve is in the closed position as shown in FIG. 6. Lower flapper element 18 also includes a disc shape portion 66 that rests on top of the thinner portion 92 of the upper flapper element in the closed position. Lower valve element may be pivotally mounted on the valve seat at 58 and spring biased to a closed position in a manner similar to the mounting of upper valve element 17 including tabs 72 and slots 73.

FIG. 7 illustrates the open position of the second flapper valve assembly. As shown in the figure, flow tube 56 has been moved downwardly against spring 54 by pressure acting on piston 51 so as to extend through valve seat 59. The lower end of flow tube 56 may have a saddle shape including two ears 74 and 75 that generally parallel the saddle shape of valve seat 59. A nipple 76 is formed on the ear 75 of the flow tube adjacent the second flapper valve element so that as flow tube 56 is moved downwardly, nipple 76 will first engage second flapper element 18 so that second flapper element 18 first begins to pivot outwardly. Ear portion 74 of the flow tube will then engage first flapper valve element 17 causing it to pivot outwardly eventually to the position shown in FIG. 7 and FIG. 3B.

As explained above, the first and second safety flapper valve assemblies are formed as an integral assembly. Each safety valve can be independently operated and is maintained in the open position while being run. Once production tubing is strung into the packer and the tubing hanger is set, the control lines are connected to the system controls. An electronic submersible pump can be deployed using the pump cable with slickline operations through the barrier valve and the integral safety valve assembly which includes the two flapper valve assemblies until the ESP has latched into a stinger located below the packer.

The system is a failsafe design. Each flapper valve assembly will automatically shut if the supply of fluid opening pressure from the surface is compromised. During normal operations the second flapper valve assembly is the primary barrier to formation pressure and can be opened and closed on the pump cable to test seal integrity.

The first flapper valve assembly is normally maintained in the open position with fluid pressure and is not activated during normal operations. Once the cable deployed electronic submersible pump is removed from the well, the first flapper valve assembly becomes the primary barrier to formation pressure and can close on a flapper valve seat to shut the well in.

Although the present invention has been described with respect to specific details, it is not intended that such details should be regarded as limitations on the scope of the invention, except to the extent that they are included in the accompanying claims.

We claim:

1. A safety flapper valve assembly for use with an oil or gas well installation having a cable deployed electronic submersible pump comprising:

a housing, a valve a dual element flapper valve, each flapper element pivotably mounted for engagement with a valve seat; and each element of the flapper valve including a cutout section for accommodating a cable of an electronic submersible pump, one of said flapper elements including a groove and a second of said flapper elements including a raised portion adapted to fit within the groove of the first element when the valve assembly is in a closed position.

2. The safety valve assembly according to claim 1 further including an axially movable flow tube for pivoting the flapper valve elements to an open position.

3. The safety flapper valve assembly of claim 1 wherein the safety flapper valve assembly prevents upward flow of fluid when in the closed position and the cable passes through the valve assembly.

4. An integral safety valve assembly for use in an oil/gas well having a cable deployed electronic submersible pump comprising:

a housing having a fluid flow path extending therethrough;

a first flapper valve assembly positioned within the housing adapted to completely close the fluid flow path; and a second flapper valve assembly axially spaced from the first flapper valve assembly and positioned within the housing and including means for allowing a cable to pass through the integral safety valve when the second flapper valve assembly is in a closed position, said second flapper valve assembly adapted to close the fluid flow path when the cable is positioned within the housing.

5. The integral safety valve assembly as claimed in claim 4 wherein each flapper valve assembly includes an axially movable flow tube for pivoting the flapper valve elements to an open position.

6. A safety system for an oil or gas well having a cable deployed electronic submersible pump positioned therein comprising:

a barrier valve including a control line for opening and closing the valve;

a housing having a fluid flow path extending therethrough a first flapper valve positioned within the housing including a control line for opening and closing the first flapper valve;

a second flapper valve positioned within the housing including a control line for opening and closing the second flapper valve, said second flapper valve includes means for allowing a cable of a deployed submersible pump to pass through the second flapper valve when the second flapper valve is in a closed position, the first flapper valve and second flapper valve being located within the fluid flow path.

* * * * *